US005901933A

United States Patent [19]

Lin

[11] Patent Number: 5,901,933

[45] Date of Patent: May 11, 1999

[54] DIMENSIONAL ADJUSTING DEVICE FOR COMPUTER KEYBOARD RACKS

[76] Inventor: Chin-Chih Lin, 2F, No. 160, Shih Ta Road, Taipei, Taiwan

[21] Appl. No.: 09/088,109

[22] Filed: Jun. 1, 1998

Related U.S. Application Data

[63] Continuation of application No. 08/879,769, Jun. 20, 1997.

[51] Int. Cl.[6] ..... E04G 3/00

[52] U.S. Cl. ..... 248/285.1; 248/298.1; 248/918

[58] Field of Search ..... 312/334.23, 334.16; 248/279.1, 298.1, 285.1, 918, 429; 108/140, 143, 102, 103

[56] References Cited

U.S. PATENT DOCUMENTS

| | | | |
|---|---|---|---|
| 4,616,798 | 10/1986 | Smeenge et al. | 248/279.1 X |
| 4,938,441 | 7/1990 | Hannah et al. | 108/143 X |
| 5,211,367 | 5/1993 | Musculus | 248/279.1 |
| 5,257,767 | 11/1993 | McConnell | 248/918 X |
| 5,294,087 | 3/1994 | Drabczyk et al. | 108/143 X |
| 5,507,571 | 4/1996 | Hoffman | 312/334.16 X |
| 5,588,375 | 12/1996 | Cotterill | 108/143 X |
| 5,681,116 | 10/1997 | Lin | 248/298.1 X |

*Primary Examiner*—Derek J. Berger
*Attorney, Agent, or Firm*—Bacon & THomas, PLLC

[57] ABSTRACT

A dimensional adjusting device for computer keyboard racks including a displacement device, a rotary device, a connecting plate, an elevating device, an elevation device, and a positioning device. The invention is characterized in that a relay plate is disposed between a fixed track and movable track of one of two slide track units, the relay plate being connected to the movable track and having two plate wings at both sides thereof. The plate wings pass through corresponding track holes in the movable track to be further connected to a plate flap at either side of a fixed plate. The invention is further characterized in that the fixed plate has a positioning device disposed therein. The positioning device is comprised of a bottom cover disposed over a front portion of the fixed plate, and two trigger pieces. The bottom cover has a partition rib defining a clearance with a front wall of the bottom cover for receiving two oppositely disposed rods with a spring sandwiched therebetween. The rods each have a projection at an upper side and a stop portion at the other side. The bottom cover further has two cover posts at both sides behind the partition rib. The trigger pieces have respective pins, notches and end notches. The pins of the trigger pieces pass through corresponding through slots at a front edge of the fixed plate such that the notches engage the projections of the rods and the end notches engage the cover posts of the bottom cover. The positioning device further comprises a top cover for sealing the bottom cover so that the rods may advance along the fixed tracks during displacement, and are positioned in place when the rods pass over the fixed tracks to extend outwardly.

6 Claims, 3 Drawing Sheets

DIMENSIONAL ADJUSTING DEVICE FOR COMPUTER KEYBOARD RACKS

This application is a Continuation of nonprovisional application Ser. No. 08/879,769 filed Jun. 20, 1997.

BACKGROUND OF THE INVENTION (a) Field of the Invention

The present invention relates generally to an improved adjusting device for keyboard racks, and more particularly to a dimensional adjusting device which may allow back and forth movement as well as up and down movement of the keyboard rack, and which may permit free rotation and adjustment of elevation of the keyboard rack.

(b) Description of the Prior Art

Various kinds of computer desks have been developed with the development of computers and peripheral equipment thereof. A conventional computer desk includes a desk surface for placement of the monitor, and a retractable drawer for supporting the keyboard. In use, the retractable drawer is pulled out. After use, the retractable drawer is pushed back into position so that the keyboard lies beneath the desk surface.

Although the retractable drawer of the conventional computer desk may be pulled outwardly or pushed inwardly, it cannot move up and down or rotate through a certain angle or its angle of elevation cannot be adjusted. Therefore, it cannot adapt to the sitting posture of the users or the angles of the hands with respect to the keyboard during typing. It is therefor imperative to find a solution to the existing problems. One solution is offered in U.S. Pat. No. 5,037,054, in which a keyboard rack substitutes the conventional retractable keyboard drawer, the keyboard rack being capable of back and forth as well as up and down displacement; besides, the angle of elevation of the keyboard rack may be adjusted as desired.

SUMMARY OF THE INVENTION

Accordingly, a primary object of the present invention is to provide a dimensional adjusting device for computer keyboard racks whereby the keyboard rack may move up and down as well as back and forth as desired, and may freely rotate. Besides the elevation of the keyboard rack may be adjusted.

BRIEF DESCRIPTION OF THE DRAWINGS

The foregoing and other features and advantages of the present invention will be more clearly understood from the following detailed description and the accompanying drawings, in which, FIG 1. is schematic elevational exploded view of a displacement device, a rotary device of the keyboard rack of the present invention.

DETAILED DESCRIPTION OF THE PREFERRED EMBODIMENTS

Figure 1:
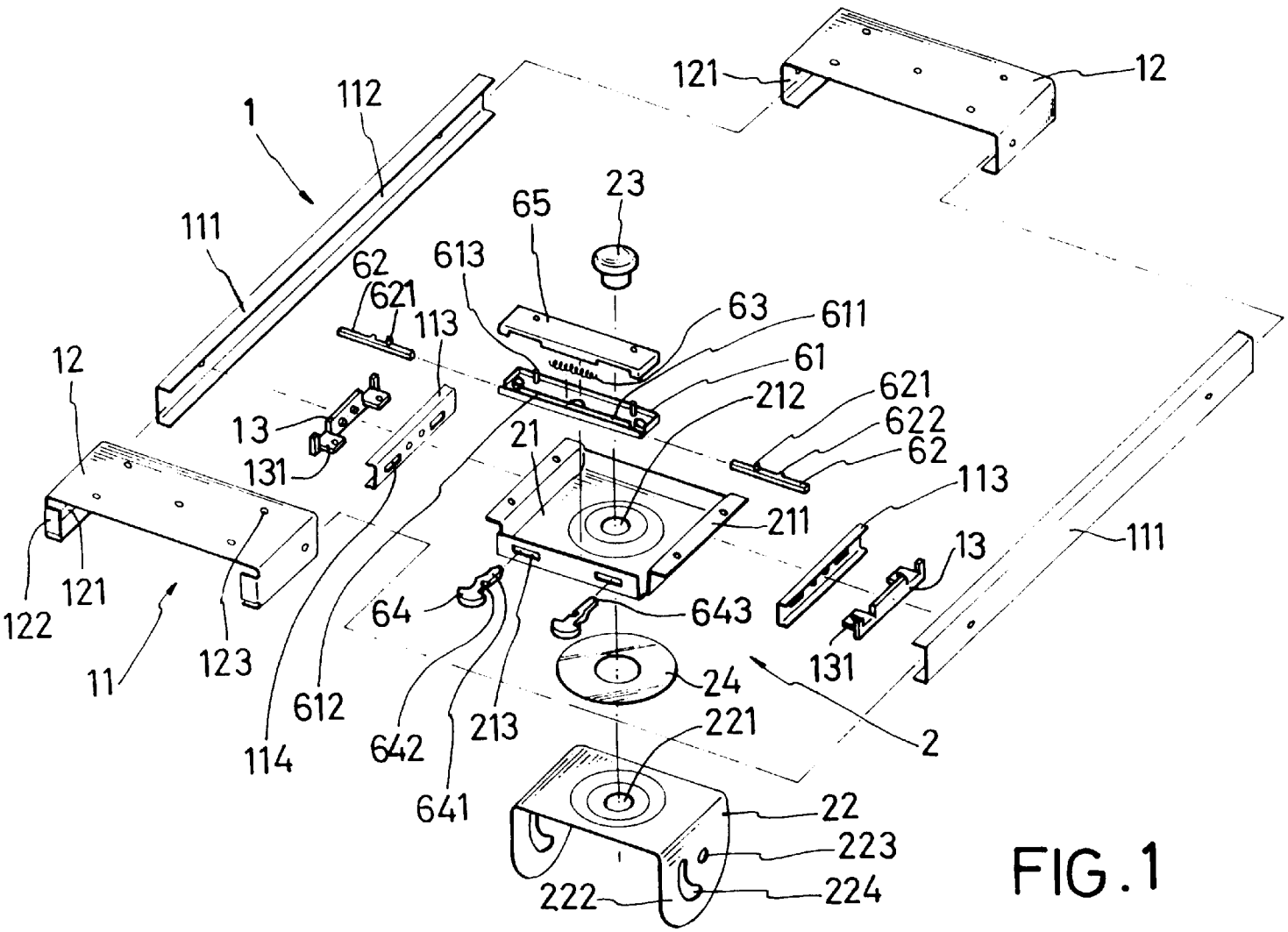
Figure 2:
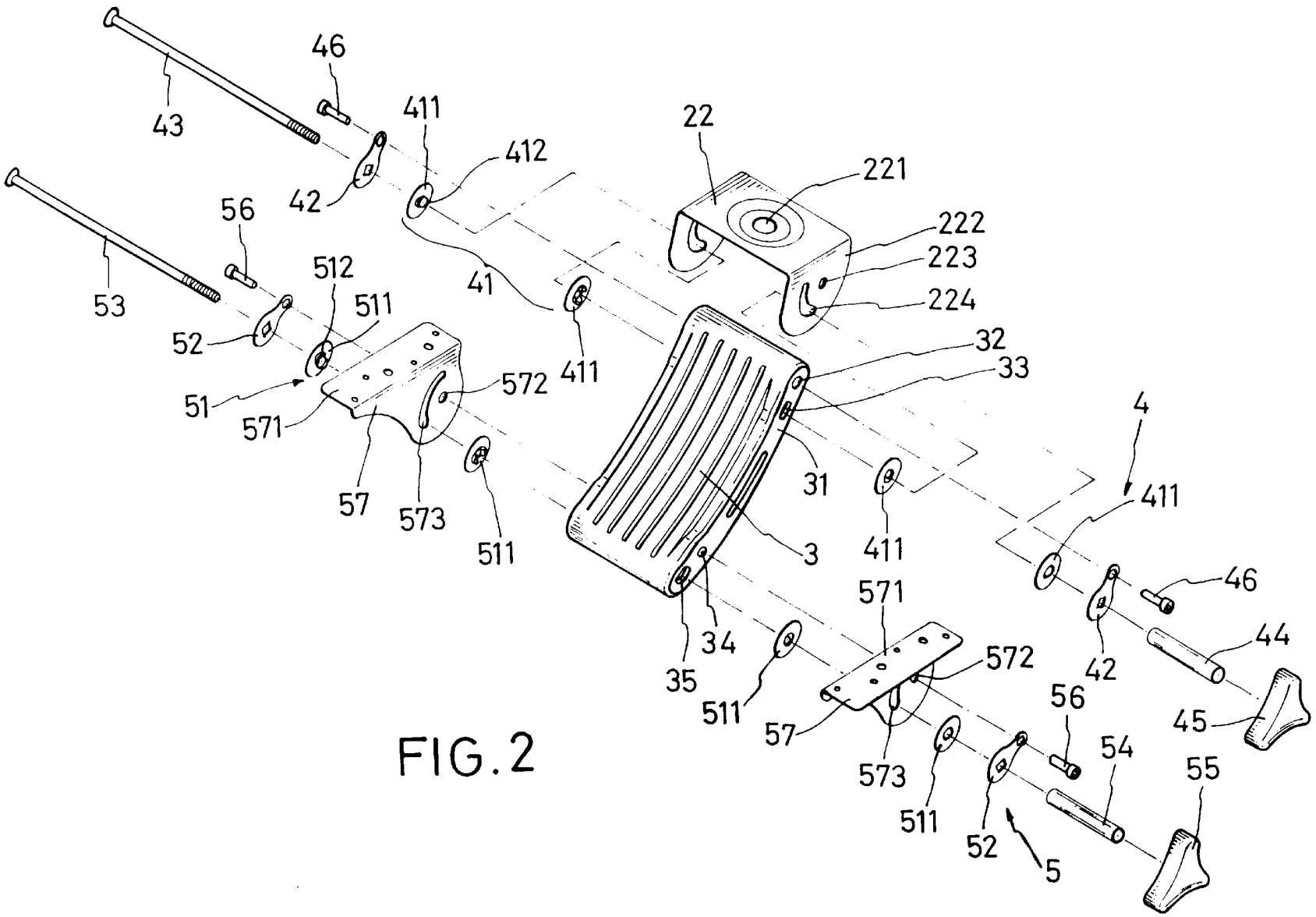
FIG. 2 is a schematic elevational exploded view of a connecting plate elevating device, and an elevation device of the keyboard rack of the present invention.
Figure 3:
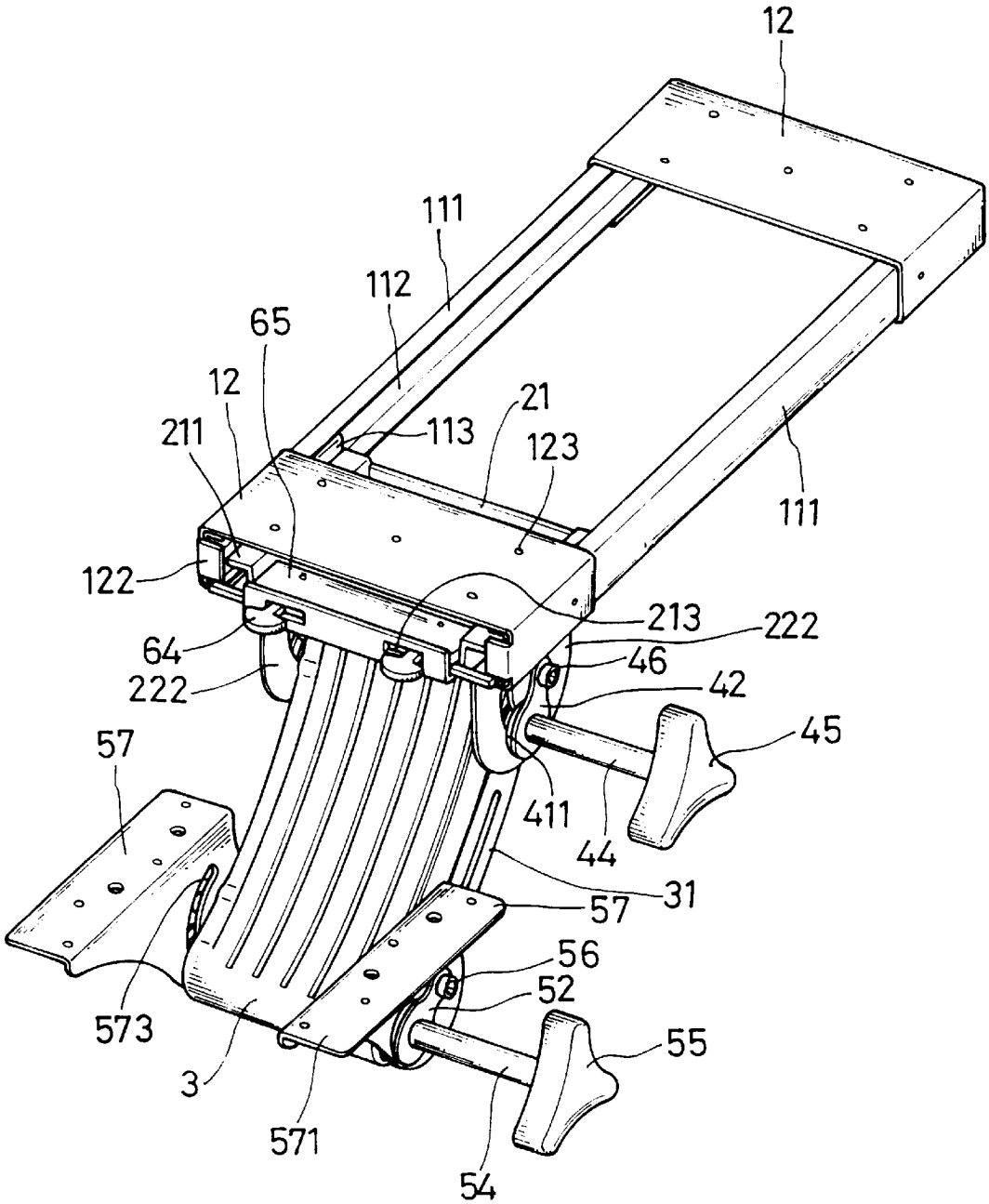
FIG. 3 is an elevational assembled view of the present invention.

As shown in the drawings, the dimensional adjusting device according to the present invention essentially comprises a displacement device 1, a rotary device 2, a connecting plate 3, an elevating device 4, an elevation device 5, and a positioning device 6.

The displacement device 1 is comprised of two opposed slide track units 11 and two track mounts 12 respectively disposed at a front end and rear end of the units. Each slide track unit 11 essentially comprises a fixed track 111 with a track groove 112 for receiving a movable track 113 of a shorter length. In between their contact surfaces are disposed conventional balls so that the slide track units 11 are in principle conventional ball type slide tracks. The slide track units 11 of the present invention differs from the conventional ones in that a relay plate 13 which has been bent is disposed between the fixed track 111 and the movable track 113 such that it is secured to the movable track 113. The relay plate 13 has two plate wings 131 which pass through corresponding track slots 114 of the movable track 113 so as to enhance the structural stress of the entire slide track unit 11 and to further couple to the rotary device 2. Both sides of the track mount 12 respectively have opposed mount grooves 121 for accommodating the fixed tracks 111 of the slide track units 11. The track mount 12 at a front end of the slide track units 11 has a pair of baffle ends 122 at front side thereof for checking the forward movement of the movable tracks 113, while the track mount 12 at a rear end of the slide track units 11 has a pair of baffle ends at a rear side thereof for checking the rearward displacement of the movable tracks 13. In addition, a plurality of mount holes 123 are disposed at an upper side of each track mount 12 for passage of screws to lock the track mounts 12 to an underside of a desk plate.

The rotary device 2 includes a fixed plate 21, an inverted-U shaped rotary support 22, and a spindle 23 pivotally joining the fixed plate 21 and the rotary support 22. The fixed plate 21 are provided with two plate flaps 211 at both sides, each matching the plate wings 131 of each movable track 13 such that the fixed plate 21, after assembly, is secured between the two movable tracks 13. In addition, the fixed plate 21 is centrally provided with a plate hole 212, and the rotary support 22 is also centrally provided with a support hole 221. The spindle 23 is passed through the plate hole 212 and the support hole 221 to lock them together such that the rotary support 22 may rotate relative to the fixed plate 21. The rotary support 22 further has two support wings 222 at both sides respectively, each support wing 222 having a center hole 223 and a upper curved slot 224. Additionally, a packing plate 24 is disposed between the fixed plate 21 and the rotary support 22.

The connecting plate 3 is a curved plate structure with a reinforcing plate 31 insertably connected to either side thereof. The connecting plate 3 is disposed between the support wings 222 of the rotary support 22 locate thereabove. An upper pivot hole 32 and an upper swing hole 33 are formed at an upper portion of each reinforcing plate 31 at either side of the connecting plate 3 for matching the center hole 223 and upper curved slot 224 of the rotary support 22. A lower portion of each reinforcing plate 31 at either side of the connecting plate 3 is also provided with a lower pivot hole 34 and a lower swing hole 35 for connection with the elevation device 5.

The elevating device 4 includes two upper clamp units 41 each having two upper clamps 411, two first packing pieces 42, an upper screw rod 43, an upper extension tube 44, an upper knob 45, and two oppositely disposed upper pivots 46. The elevating device 4 locks the rotary support 22 to the upper portion of the connecting plate 3. The upper clamp units 41 are each disposed at either side of the rotary support 22 at the support wing 222. The upper screw rod 43 is passed in sequence through one packing piece 42, one upper clamp unit 41, two upper curved slots 224 and upper swing holes 33, the other of the upper clamp units 41, the other of the packing pieces 42, and the upper extension tube 44 to screwably couple to the upper knob 45. The upper pivots 45 are passed through upper ends of the packing pieces 42 at both sides of the rotary support 22 and the center holes 223 to lock into the upper pivot holes 32 of the connecting plate 3. By turning the upper knob 45, the pressure of the upper clamp units 41 on the upper curved slots 224 may be controlled. The upper pivots 45 further serve as pivots whereby the upward and downward displacement of the connecting plate 3 along the upper curved slots 224 may be adjusted.

The elevation device 5 essentially comprises elements similar to those of the elevating device 4. It includes two lower clamp units 51 each having two lower clamp 511, two second packing pieces 52, lower screw rod 53, a lower extension tube 54, a lower knob 55, and two oppositely disposed lower pivots 56. The elevation device 5 differs from the elevating device 4 in that it further comprises two rack members 57 in the shape of an inverted L, each of which is disposed between the two lower clamp 511 of each lower clamp unit 51. Each member 57 has a rack surface 571 at a horizontal side thereof for connection with keyboard rack (such as the one disclosed in U.S. Ser. No. 08/598,002), a through hole 572 and a lower curved slot 573 at a vertical side thereof for matching the lower pivot hole 34 and the lower swing hole 35 of the connecting plate 3. The lower screw rod 53 passes through the second packing pieces 52, lower clamping units 51, lower curved slots 573 and the lower swing holes 35 and further through the lower extension tube 54 to screwably lock with the lower knob 55. Additionally, the two opposed lower pivots 56 are passed through the second packing pieces 52 and through holes 572 and secured in the lower pivot holes 34 at both sides of the connecting plate 3. By turning the lower knob 55, the pressure of the two lower clamp units 51 on the lower curved slots 573 may be controlled, and the lower pivots 56 may serve as pivots for adjustment of the elevation of the rack members 57 along the lower curved slots 573.

Furthermore, each upper clamp plate 411 and each lower clamp plate 511 are respectively provided with a plurality of curved posts 412, 512 at one side thereof for insertion into corresponding holes and slots for positioning purposes. The clamp plates are made of hard, resilient plastic materials so that they may firmly clamp the curved slots to achieve better clamping and securing effects.

The positioning device 6 is located between the displacement device 1 and the rotary device 2. It includes a bottom cover 51 which is disposed at a front rim of the fixed plate 21. The bottom cover 61 is internally provided with a partition rib 611 which defines a clearance 612 with a front wall of the bottom cover 61, so that two rod 62 may be respectively disposed at both sides of the clearance 612. A spring 63 is provided between the rod 62. The rods 62 each have a projection 621 at an upper side and a stop portion 622 at the other side in a vertical direction for preventing the rods 62 from disengaging from the bottom cover 61. In addition, two cover posts 613 are symmetrically disposed behind the partition rib 611 of the bottom cover 61 so that respective pins 641 of two trigger pieces 64 may pass through two through slots 213 formed at a front edge of the fixed plate 21 to be located above the bottom cover 61. The trigger pieces 64 each further have a notch 642 for receiving the corresponding projection 621, and an end notch 643 for receiving the corresponding cover post 613, which may serve as the fulcrum of leverage. Finally, a top cover 65 is put on top of the bottom cover 61 for sealing purposes, and assembly of the positioning device 6 is thus accomplished.

In actual use, utilizing the stretching action of the spring 63, the outer ends of the two rods 62 are always in contact with the lower portion of the fixed tracks 111 so as to ensure stability in displacement. When the keyboard rack is pulled outwardly to its extreme limit, the movable tracks 113 will urge against the baffle ends 122 of the track mounts 12. At this point, the two rods 62 will pass over the fixed tracks 111 and are fully extended so that the fixed plate 21 can no longer be held between the two slide track units 11. In order to close the keyboard rack, the trigger pieces 63 have to be pulled inwardly so that the rods 62 press the spring 63 to allow the fixed plate 21 to be folded or closed.

The present invention has various advantages. For instance, the arrangement of the relay plates 13 may enhance the structural stress of the slide track units 11 so that placement of the user's hands on the keyboard rack will no lead to deformation of the tracks or balls, thus the useful life of the keyboard rack may be prolonged. At the same time, the relay plates 13 may be used to connect to the fixed plate 21 of the rotary device 2. Furthermore, the arrangement of the positioning device 6 may enable provide enhance stability during forward and rearward displacement of the fixed plate 21, and when the keyboard rack is pulled to its extreme limit, the positioning device 6 may provide good positioning effects. In addition, the rotary device 2 enables the rotary support 22 to bias to the left or right as desired. Furthermore, the elevating device 4 connects the connecting plate 3 to the rotary support 22 for controlling the elevation of the connecting plate 3 along the upper curved slots 224. The elevation device 5 that connects the connecting plate 3 may further control the angle of elevation of the rack members 57 relative to the connecting plate 3. In brief, the present invention provides an ergonomically designed keyboard rack the position and elevation of which may be freely adjusted to allows the user to operate the keyboard in a best posture.

Although the present invention has been illustrated and described with reference to the preferred embodiment thereof, it should be understood that it is in no way limited to the details of such embodiment but is capable of numerous modifications within the scope of the appended claims.

What is claimed is:

1. A dimensional adjusting device for enabling adjustment of a computer keyboard rack, said dimensional adjusting device being adapted to be disposed at an underside of a desk surface of a computer desk and to be connected to the computer keyboard rack, comprising:

a displacement device, said displacement device comprising two slide track units and two opposed track mounts, said slide track units each comprising a fixed track having a track groove, and a movable track being accommodated and sidable in said track groove of said fixed track, said fixed tracks of said two slide track units being disposed between said track mounts, said track mounts having respective upper sides adapted to be connected to the underside of the desk surface; and a relay plate disposed between said fixed track and said movable track of each of said slide track units, said relay plate being arranged to connect the movable track to a rotary device to which the keyboard rack is secured, wherein said relay plate is disposed between said fixed track and the movable track, and secured to the movable track so as to enhance the structural strength of the respective slide track unit in which the relay plate is disposed.

2. A dimensional adjusting device for enabling adjustment of a computer keyboard rack as claimed in claim 1, wherein said movable track has a generally u-shaped cross-section, and said relay plate is positioned between arms of said u-shape.

3. A dimensional adjusting device for enabling adjustment of a computer keyboard rack as claimed in claim 1, wherein said relay plate is coupled to the rotary device by two plate wings at opposite ends of the relay plate, said plate wings passing through corresponding track slots of the movable track.

4. A dimensional adjusting device for enabling adjustment of a computer keyboard rack as claimed in claim 3, wherein said movable track has a generally u-shaped cross-section, and said relay plate is positioned between arms of said u-shape.

5. A dimensional adjusting device for enabling adjustment of a computer keyboard rack as claimed in claim 3, wherein said plate wings pass through the corresponding slots in the movable track to be further connected to a plate flap at either side of a fixed plate of the rotary device.

6. A dimensional adjusting device for enabling adjustment of a computer keyboard rack as claimed in claim 5, wherein said fixed plate is connected to said movable tracks, and said rotary device includes a rotary support in the shape of an inverted-U disposed beneath said fixed plate, and a spindle passing through and joining said fixed plate and said rotary support such that said rotary support may rotate relative to said fixed plate.

* * * * *